United States Patent [19]

Tsao

[11] Patent Number: 4,519,612

[45] Date of Patent: May 28, 1985

[54] GOLF PUTTER

[76] Inventor: Thomas K. Tsao, 441 Discovery Rd., Virginia Beach, Va. 23451

[21] Appl. No.: 495,502

[22] Filed: May 17, 1983

[51] Int. Cl.[3] ..... A63B 69/36; A63B 53/04

[52] U.S. Cl. ..... 273/163 R; 273/183 E; 273/167 A; 273/171; 273/174

[58] Field of Search ..... 273/174, 167 A, 183 E, 273/164, 163 R, 173, 169, 172; D21/219, 217, D21/218

[56] References Cited

U.S. PATENT DOCUMENTS

| | | | |
|---|---|---|---|
| 2,155,830 | 4/1939 | Howard | 273/79 |
| 2,929,631 | 3/1960 | Gillon | 273/183 E |
| 3,143,349 | 8/1964 | MacIntyre | 273/171 |
| 3,199,873 | 8/1965 | Surratt | 273/167 A X |
| 3,486,755 | 12/1969 | Hodge | 273/167 A |
| 3,548,504 | 12/1970 | Sykes | 273/183 E |
| 3,698,093 | 10/1972 | Marshall | 273/183 D |
| 3,841,639 | 10/1974 | Werner | 273/167 A |
| 3,880,430 | 4/1975 | McCabe | 273/183 D |
| 3,885,796 | 5/1975 | King | 273/186 C |
| 4,073,492 | 2/1978 | Taylor | 273/167 G |
| 4,082,286 | 4/1978 | La Breche | 273/183 D X |
| 4,136,877 | 1/1979 | Antonious | 273/183 D |
| 4,147,357 | 4/1979 | Strop | 273/167 A |
| 4,167,268 | 9/1979 | Lorang | 273/183 E |
| 4,194,739 | 3/1980 | Thompson | 273/183 D |
| 4,209,172 | 6/1980 | Yamamoto | 273/183 D |
| 4,222,566 | 9/1980 | Berry | 273/164 |
| 4,231,576 | 11/1980 | Perkins | 273/183 D |
| 4,340,229 | 7/1982 | Stuff | 273/183 E X |

*Primary Examiner*—George J. Marlo

*Attorney, Agent, or Firm*—Holman & Stern

[57] ABSTRACT

A golf putter has a club head with a golfer's sighting device in the form of an elongated prism positioned at the top of the club head and aligned with the intended location of ball impact on the club head putting face. An elongated colored strip is disposed in or under the prism and appears maximally wide when viewed from above the prism in a vertical alignment plane which includes the impact spot and the upper edge of the prism, thereby indicating that the golfer's head is properly positioned over the club head. The indicator can be used during actual play and/or, in conjunction with a pivotable shaft, to select the optimal angle between the head and shaft in fabricating a custom putter. An aluminum or other oxide coating on the club head provides the putting face with a greater friction and facilitates adherence of a material having low friction characteristis, such as TEFLON, to the bottom surface of the club head. The edge between the putting face and bottom surface tapers upwardly toward opposite ends of the head from the general location of intended impact with the ball to reduce the likelihood of erratic putting strokes due to unevenly cut grass. The TEFLON coating reduces friction between the bottom surface of the putter and the grass to thereby further assure steady, even putting strokes.

17 Claims, 16 Drawing Figures

GOLF PUTTER

BACKGROUND OF THE INVENTION

1. Technical Field

The present invention relates to improvements in golf putters and, more particularly, such improvements which enhance putting effectiveness and facilitates custom putter fabrication.

2. Discussion of the Prior Art

There are numerous devices in the prior art which are intended to facilitate alignment of the golfer's line of sight in a vertical plane which includes the golf ball and the cup or hole. Examples of such devices may be found in U.S. Pat. Nos. 3,548,504 (Sykes), 4,167,268 (Lorang), 3,698,093 (Marshall), 4,136,877 (Antonious), 4,231,576 (Perkins) and 3,880,430 (McCabe). All of these devices require that two vertically-spaced members be aligned or centered in the golfer's line of sight so that the golfer's head will then be properly positioned over the club head and ball. In order to effectively use such devices, the golfer must have nearly perfect vision. In other words, if the golfer has less than twenty-twenty vision, there is a range of positions for the golfer's head wherein the two spaced members will appear to be aligned, such range becoming larger as the golfer's vision becomes worse. This permits slight mis-alignment of the golfer's head and improper alignment between the club head and the ball. Apart from the foregoing, the prior art alignment devices take considerable time to use as the golfer moves his or her head back and forth in an effort to center or align the alignment members.

Many prior art putters suffer from the problem of frictional drag forces exerted by grass along the bottom surface of the putter during a putting stroke. Such drag results in turning of the club head and/or erratic forward motion of the club head. In either case, frictional drag causes the ball to be stroked inaccurately.

Proper putter selection is crucial to a golfer's game, the weight of the club head and the angle of the club's shaft relative to the club head are two important parameters which can vary greatly from golfer to golfer. The proper angle of the shaft for a particular golfer depends very much on the golfer's stance, including the position of the golfer's head during the putting stroke. In particular, it is important that the shaft be at a comfortable angle when the golfer's head is positioned over the club with his or her line of sight in the vertical plane that includes the ball, the cup and the desired impact point on the club head. This position of the golfer's line of sight is most often not taken into consideration when custom putters are designed.

OBJECTS AND SUMMARY OF THE INVENTION

It is therefore an object of the present invention to provide a sighting device for use with a putter which provides a simple "go-no go" type of indication when the golfer's line of sight is properly aligned with the desired ball-impact point on the club head.

It is another object of the present invention to provide a sighting device for a golf putter which can be readily used while playing or in conjunction with an adjustable model putter intended for use in selecting characteristics of a custom putter.

A further object of the present invention is to provide a golf putter which permits a golfer to quickly position his or her head so that the golfer's line of sight is perfectly aligned with the ball, cup and desired impact point of the ball on the club head.

Yet another object of the present invention is to provide an alignment device for putting which can be used for practice and/or tournament play and which does not require perfect vision for use.

It is still a further object of the present invention to provide a golf putter which is configured to minimize frictional drag by grass along the bottom of the club head during a putting stroke.

In accordance with the present invention a putter is provided with a sighting device in the form of a prism which includes two converging sides intersecting at a top edge. In the preferred embodiment the prism is an isosceles or equilateral triangle. The prism is affixed to the top surface of the club head with the top edge of the prism aligned with and extending rearwardly from the desired ball-impact point on the putting face. An elongated member, preferably colored red, is disposed within the prims parallel to and in the same vertical plane as the top prism edge. When the golfer's line of sight is properly positioned above the prism in a vertical plane which includes the top prism edge, the elongated member and the desired impact point on the club head, a maximum width of the elongated object appears in the prism. The range at which this maximum width appears is relatively small so that a precise positioning of the golfer's line of sight can be easily achieved by simply noticing a dramatic color contrast in the prism.

The putter may also be coated with aluminum oxide, particularly on its front surface to facilitate frictional engagement between the putting space and the golf ball, thereby permitting top spin to be applied to the ball during a golf stroke. The aluminum oxide also facilitates adherence of Teflon to the bottom surface of the club head, thereby reducing the coefficient of friction of the bottom surface of the club head when it passes over grass during a putting stroke.

Further reduction of friction along the bottom surface is achieved by tapering the forward portion of the bottom surface of the club so that the proximal and distal ends of the club head are raised above the ground at the putting face. This provides a forward face which is vertically thicker at the point of ball impact than at the club head ends so that only a relatively narrow portion of the bottom edge of the putting face contacts the grass during a putting stroke.

The prism alignment arrangement can be secured by adhesive or like to the top surface of the club head. Alternatively, the prism may be removably secured to the club head by inserting it into a suitably provided channel defined in the top surface of the club head. In either case, the alignment prism may be employed with an adjustable putter designed for use in selecting a custom putter configuration. Specifically, the putter shaft may be pivotably secured to the club head so that the golfer can adjust the shaft angle to that which is most comfortable when the golfer's head is properly aligned above the prism. In addition, the club head may be provided with adjustable weights so that the desired heft and feel of the club may be custom-selected. Once the club head weight and shaft angle are selected by the golfer, a custom putter may be fabricated.

BRIEF DESCRIPTION OF THE DRAWINGS

These and other objects, features and many of the attendant advantages of the invention will be better understood upon a reading of the following detailed description when considered in connection with the accompanying drawings wherein like parts in each of the several figures are identified by the same reference numerals, and wherein.

DESCRIPTION OF THE PREFERRED EMBODIMENTS

Figure 1:
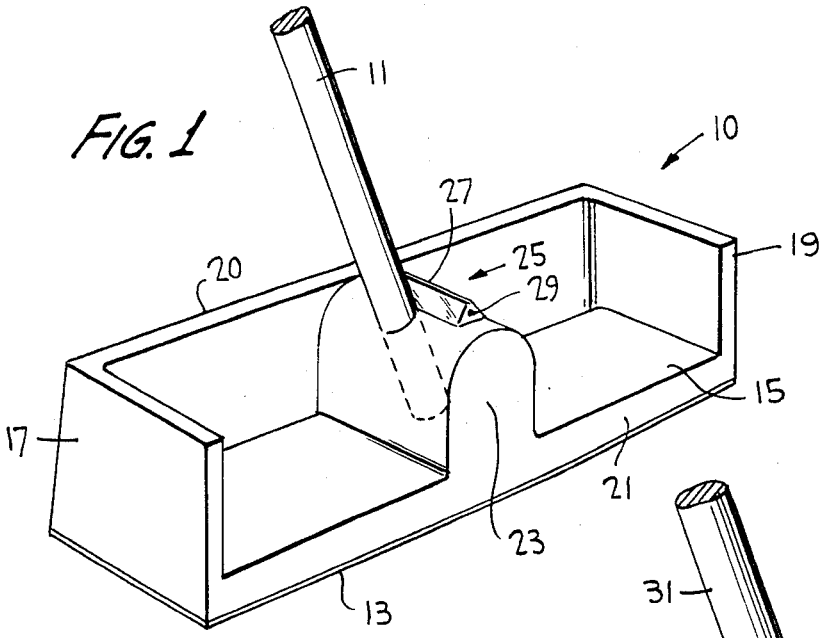
FIG. 1 is a view in perspective from behind of a golf putter club head and part of a shaft constructed in accordance with the present invention.

Referring specifically to FIG. 1 of the accompanying drawings, a golf putter constructed in accordance with the present invention includes a club head generally designated by the reference numeral 10 and a shaft 11 secured to the club head. The club head 10 is made of steel, aluminum, or other suitable material, and is provided with a coating 13 of low friction material, such as Teflon, on its bottom surface. The coating 13 is adhered to the bottom of a generally rectangular base having its major dimension extending between the proximal end 17 and distal end 19 of the club head, and having its minor dimension extending between the forward or putting face 20 and the rear edge 21 of the club. The height of base 15 is considerably lower than the putting face 20 and the sidewalls defining proximal end 17 and distal end 19. Consequently, the club head may be looked upon as a box which is closed on three sides and along its bottom but is open at its top and along its rear above edge 21. A central support member 23 extends upwardly in the open space of the club to the level of the tops of the forward putting face 20 and the side walls 17, 19. Shaft 11 is secured to the central support member 23 in any suitable manner, including adhesively securing the shaft in a bore defined in support member 23. A prism 25 is secured at the top of support member 23 by adhesive, or the like. Prism 25 is elongated in the minor dimension of base 15 and has a substantially equilateral trangular cross section. By means of this configuration, the prism has two converging sides which intersect at an upper edge 27 that is aligned with the desired transverse location on the putting face 20 at which the club is to strike a golf ball. An elongated object 29 is disposed within prism 25 below and parallel to upper edge 27. Elongated object 29 and upper edge 27 are disposed in a common vertical plane which, when the putter is properly used, includes the golfer's line of sight and the desired ball-impact location on putting face 20.

The bottom surface of the club head 10 tapers upwardly from the region below central support member 23 to each of the proximal end 17 and distal end 19. This taper, in the embodiment of FIG. 1, serves to raise all of the bottom surface of club head 10, except for the transverse mid portion thereof, above the grass on the putting green when the putter is in use. Typically, the angle of taper is approximately 2-½°. The purpose of the taper is to minimize the possibility that a portion of the club face will strike an uneven portion of the green during a putting stroke and result in erratic stroking or turning of the club. The low friction coating 13 reduces any frictional drag that might occur between the bottom of the club and the putting green during a putting stroke.

Figure 2:
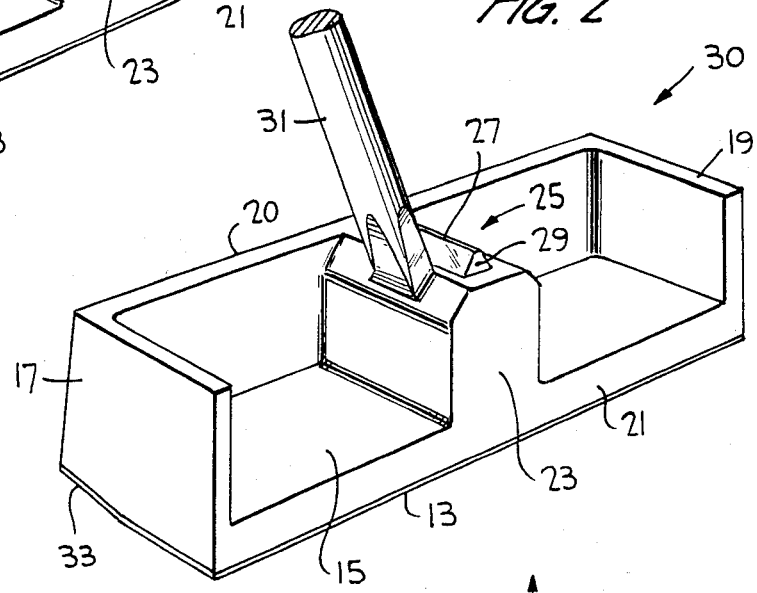
FIG. 2 is a view in perspective similar to that of FIG. 1 for a modified golf putter club head end shaft according to the present invention.

The putter of FIG. 2 includes a club head 30 and shaft 31 and is very much similar to the putter of FIG. 1 with two important exceptions. First, shaft 31 is formed integrally with club head 30 at the central support member 23 rather than being assembled to the club head during manufacture. Second, the taper in the bottom surface of the club head 30 exists only at the forward-most portion 33 of the club head, leaving the entire rear section of the bottom surface, between proximal end 17 and distal end 19, flush with the ground. This partial taper configuration 33 permits the bottom edge of the putting face 20 to avoid uneven sections of the green during the putting stroke while also permitting the club head 30 to rest stably on the ground rather than rocking as would be the case for the club head 10 of FIG. 1. The forward taper in club head 30 at proximal end 17 is visible in FIG. 2 and is generally designated by the reference numeral 33.

Either of club heads 10 and 30 may be coated with an oxide layer, such as aluminum oxide, along any or all of its exposed surfaces. By so coating the front or putting face 20, that face is dulled against reflection, is made more durable, and, most importantly, provides more of a frictional contact with the golf ball so as to permit application of overspin to the golf ball during a putting stroke. Coating of the bottom of clubs 10 or 30 facilitates adherence of the low friction coating 13 thereto, particularly when such coating is a layer of Teflon.

In the preferred embodiments of both club heads 10 and 30, the front face 20 tapers slightly from the vertical so that its bottom edge is slightly more forward than its top edge. Typically, this taper is on the order of 10° or less. This taper or loft also facilitates application of top spin to the golf ball during a stroke.

Figure 4:
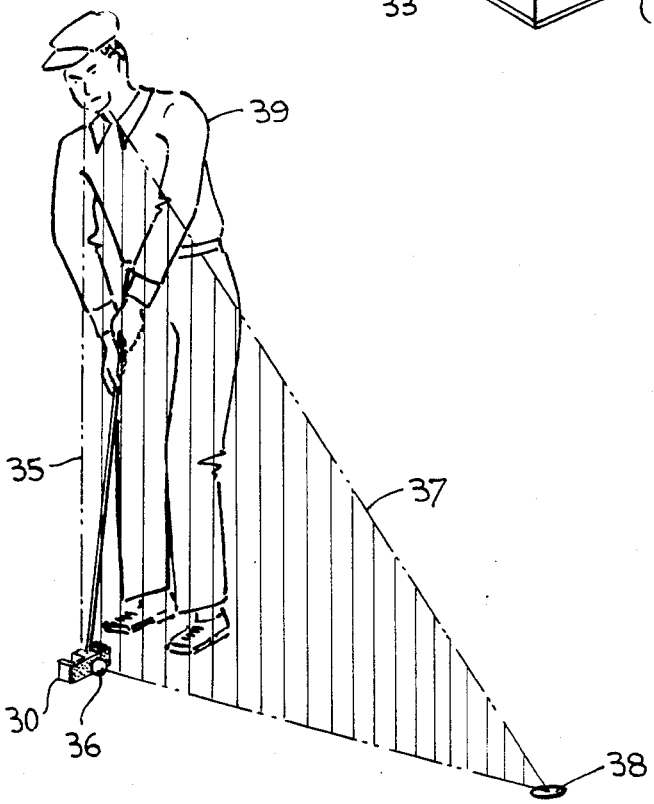
FIG. 4 is an illustration in perspective of a golfer utilizing the putter of the present invention and showing the vertical alignment plane between the golfer's line of sight, the club head, the ball and the cup.
Figure 3:
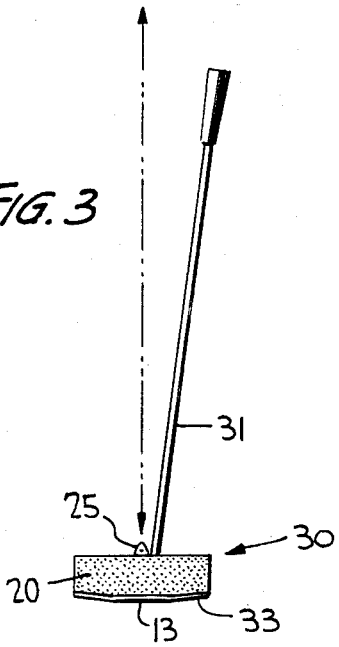
FIG. 3 is a front view in elevation of a putter constructed in accordance with the present invention, the figure also illustrating the desired line of sight of a golfer relative to the club head.
Figure 5:
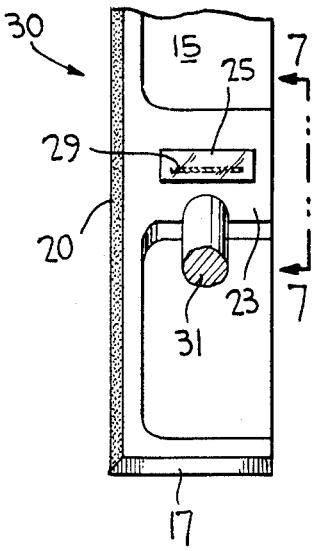
FIG. 5 is a plan view from above a club head of the present invention wherein the line of sight is slightly off center with respect to the alignment device.
Figure 6:
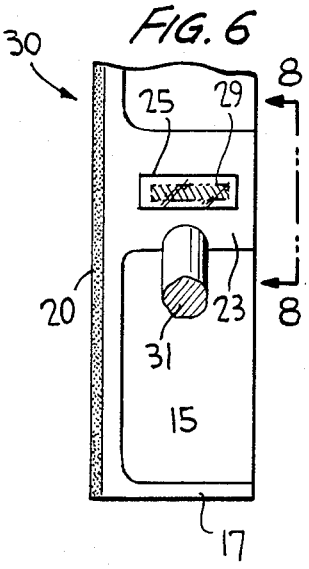
FIG. 6 is a view from above of the club head of FIG. 5 but wherein the line of sight is substantially centered with respect to the club sighting device.
Figure 7:
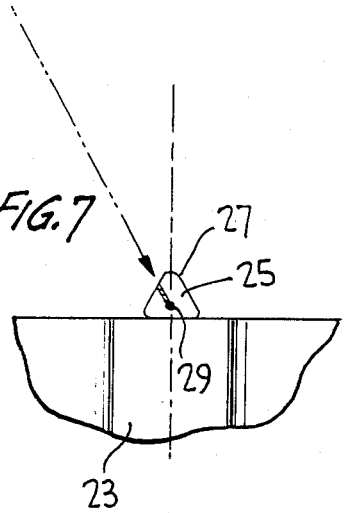
FIG. 7 is a view taken along lines 7—7 of FIG. 5.
Figure 8:
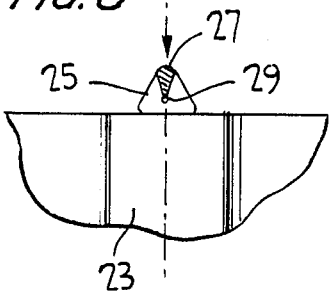
FIG. 8 is a view taken along lines 8—8 of FIG. 6.

The illustrations in FIGS. 3 and 4 indicate the manner in which the golf putter of the present invention is utilized to properly align a putt. Specifically, a golfer 39 stands with his or her head over the club 30 so that his or her vertical line of sight 35 is directly above the upper edge 27 of prism 25. This places the line of sight 35 in a vertical plane 37 which includes upper edge 27 of prism 25, the hole or cup 38, the ball 36 and the desired point of contact on the club face. The manner in which the golfer immediately determines whether or not his or her line of sight is properly aligned in plane 37 is illustrated in FIGS. 5, 6, 7 and 8. Specifically, when the golfer's line of sight is not properly positioned directly over the upper edge or apex 27 of the prism, the view of the prism appears as illustrated in FIGS. 5 and 7. Specifically, when the line of sight 35' (FIG. 7) is off-center, the observer views the object 29 only through a single face of prism 25 and therefore sees a relatively narrow refracted image of that object. If, however, the observer's line of sight 35 is directly over the apex or top edge 27 of the prism, the view of object 29 is through parts of both of the converging surfaces of the prism and a very broad image of object 29 is seen. This is virtually a "go-no go" indication since the broad image of object 29 narrows immediately upon slight change of the line of sight from vertically above the apex 27. In this manner, the golfer can easily properly align his or her line of sight in plane 37 (FIG. 4) to achieve the optimum position for putting relative to the cup 38.

Figure 9:
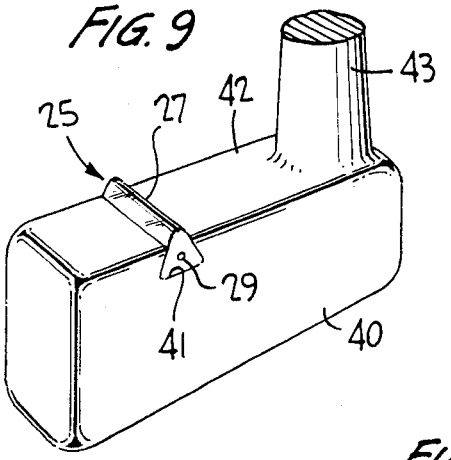
FIG. 9 is a view in perspective of a putter club head showing one possible means for securing the sighting device to the club head.
Figure 10:
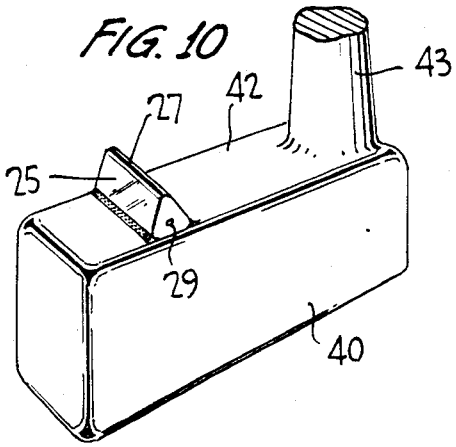
FIG. 10 is a view in perspective of a putter club head showing an alternative means of securing the sighting device to the club head.

Another embodiment of the present invention is illustrated as club head 40 in FIG. 9. The putter club head 40 has a shaft 43 secured thereto and has a channel 41 defined in its top surface 42. Channel 41 is configured to receive prism 25 therein in a slidable engagement and therefore extends generally rearward from the putting face of the club head 40. The transverse position of channel 41 is such that the prism 25 is received therein with its apex or upper edge 27 aligned in a vertical plane with the desired impact location on the club during a putting stroke. The prism 25 may be secured in channel 41 by means of an adhesive, or the like; the prism may also be frictionally engaged in the channel 41. A substantially identical putter club head is illustrated in FIG. 10 wherein channel 41 has been removed and the prism 25 is secured to the top surface 42 of the club head by means of adhesive or the like. Either embodiment is useful and feasible.

The alignment device embodied by prism 25 has been described as serving the function of aligning the golfer's line of sight in the appropriate vertical alignment plane so as to facilitate proper putting strokes during play. The same alignment prism may be employed in conjunction with a universal template type of golf putter which permits a golfer to have the optimum putter configuration customized for him or her. Specifically, and referring to FIGS. 11–16, a putter club head 50 is configured in a manner similar to club heads 10 and 30 of FIGS. 1 and 2, respectively. Club head 50 has a bottom layer 13 secured to the underside of a rectangular base member 15. Proximal end wall 17 and distal end wall 19 are interconnected by the front face 20 to provide the enclosure which is open at its top and at the rear end above the rear wall 21 of base member 15. A central support member 23 has prism 25 secured at its top and aligned in the same manner as described in relation to club heads 10 and 30. A shaft 51 has a horizontally extending cylindrical bar 53 projecting into central support member 23 through a hole 55 in the rear side of the support member. A tapped bore 57 projects radially through central support member 23, terminating at the periphery of hole 55. Bore 57 receives a thumb screw 59 in threaded engagement such that the thumb screw can be inserted selectively into bore 57 to lock the rotational position of cylindrical member 53 in hole 55. This arrangement permits the angle of shaft 51 relative to club head 50 to be adjusted and then locked in place. A protractor-like gauge 60 may be employed to measure the shaft angle at which a golfer is most comfortable when the golfer's line of vision is aligned in the vertical alignment plane above the upper edge 27 of prism 25.

Figure 11:
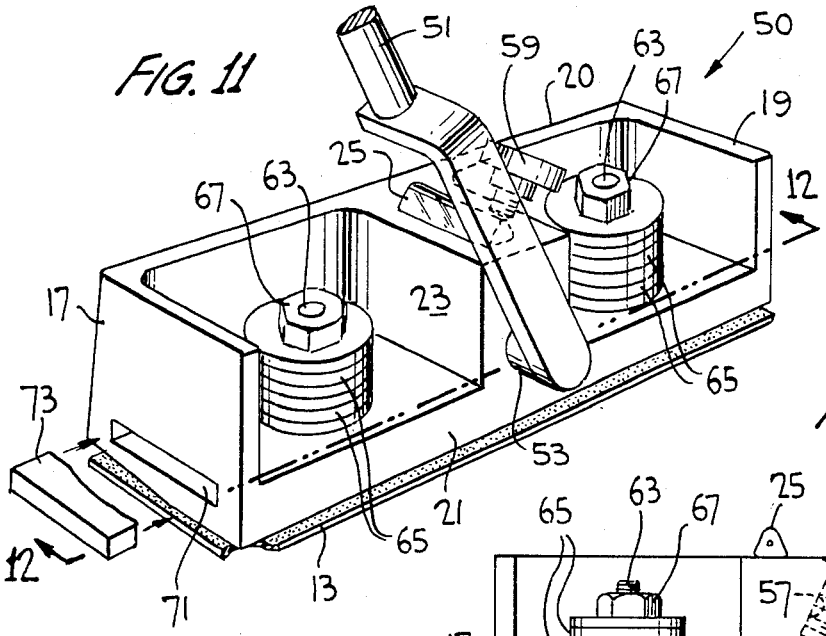
FIG. 11 is a view in perspective from behind a club head according to the present invention wherein the club head may be adjustable weighted and a shaft may be positioned at an adjustable angle with respect to the club head.
Figure 12:
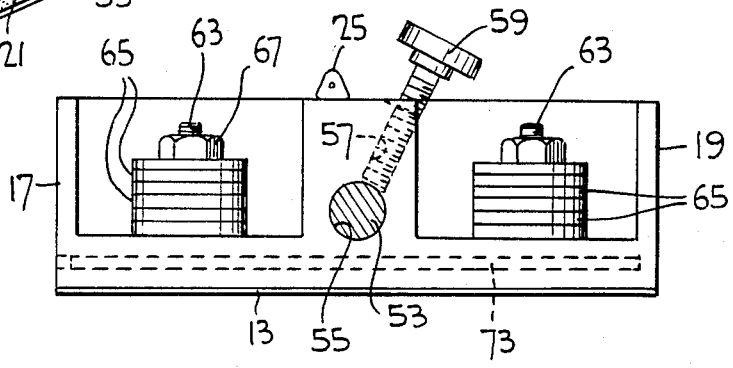
FIG. 12 is a rear view in elevation of the club head of FIG. 11.
Figure 13:
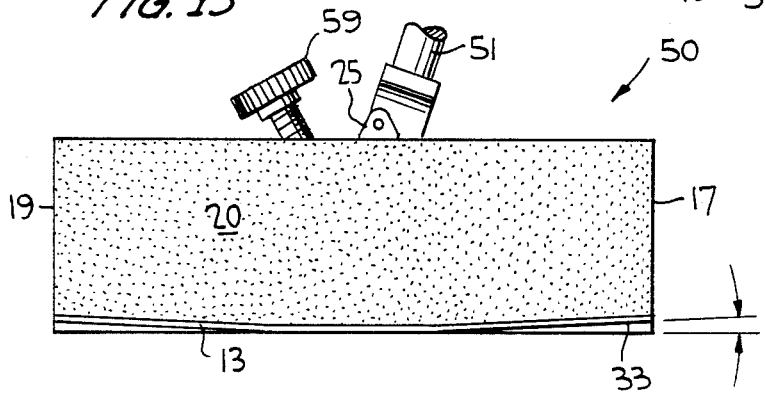
FIG. 13 is a front view in elevation of the putter of FIGS. 11 and 12.
Figure 14:
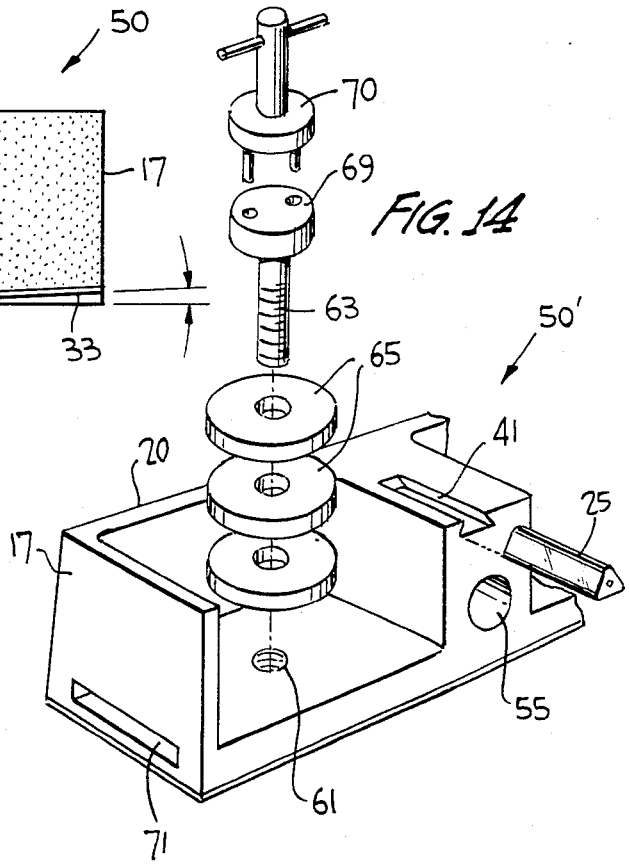
FIG. 14 is an exploded view in perspective showing the manner in which the club head of FIGS. 11–13 may be adjustably weighted.
Figure 15:
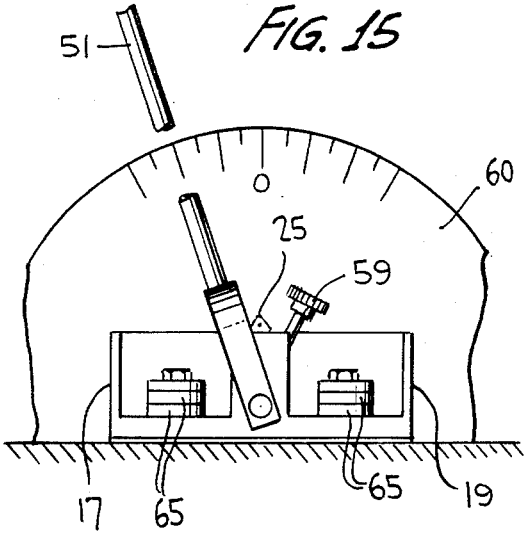
FIG. 15 is a diagrammatic view illustrating the manner in which the angle of the club shaft of the golf club of FIGS. 11–14 may be measured for purposes of fabricating a custom putter.

The central support member 23 subdivides the space between end walls 17 and 19 into two compartments, each of which has a tapped hole 61 extending downwardly into base member 15. Each tapped hole 61 is adapted to receive a screw member 63 on which a plurality of washers 65 may be placed. In the embodiment of FIGS. 11 and 12, the washers are locked in place on screw 63 by means of a nut 67. Alternatively, screw 63 may have a head 69 of the type which can be actuated by the two-pronged tool 70 used by golfers to adjust their spikes. In either case, the weight of the club head can be adjusted by adding or removing washers 65 from screw 63. When a putter weight is achieved which is comfortable to the golfer, this weight can be recorded and utilized in conjunction with the measured shaft angle to permit fabrication of the optimum putter for that particular golfer.

Another approach to adjustably weighting the putter, which approach can be used either for the custom fabrication template or for actual use in play, involves providing an elongated slot 71 extending through base member 15 from one of the side walls 17. This slot is adapted to receive a weighted plate 73 in slidable engagement. Plates 73 of different weight may be inserted into the slot 71 until the user is comforable. Since plate 73 is disposed relatively low within the club head profile, it serves to lower the center of gravity of the club head. A lower center of gravity is advantageous for shots made from the fringe of the putting green without requiring that the lower surface of the putter be placed down into the relatively high fringe grass. In addition, plate 73, by extending substantially across the width of the club head, permits a proper follow through to be obtained even with a slight off-center mis-hit of the ball. It will be appreciated that a golfer can insert differently weighted plates 73 into slot 71 to achieve the desired effect for different shots.

Figure 16:
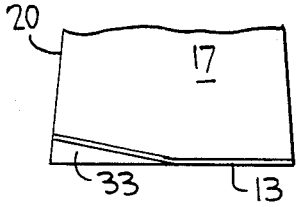
FIG. 16 is a partial end view in elevation of the club head of the putter of FIGS. 11–15.

The representation of FIG. 16 illustrates the configuration previously described in relation to FIG. 2 wherein only the forward portion of the club has the transverse upward taper from the center of the club out toward ends 17 and 19. This configuration is useful with either the customizing template or the putter actually used to play in accordance with the present invention.

As noted above, the taper 33 is at an angle of approximately 2-½° and prevents stubbing of the leading edge of the putter by grass. Such stubbing tends to turn the club during the putting stroke, resulting in an errant putt.

The plate 73 which may be added to the putter to lower its center of gravity permits the upwardly rising or lofted putter face 20, upon contact with the ball, to strike the ball at the lower part of the head where the center of gravity is disposed. This, in effect, creates an effective "sweet spot" and permits more effective putting action. The plate 73 is preferably made of lead or tungsten steel.

From the foregoing description it will be appreciated that an improved golf putter has been provided wherein a "go-no go" alignment prism permits more efficient alignment of the golfer's line of sight than has heretofor been possible. In addition, the Teflon or other low friction coating on the bottom of the putter minimizes frictional engagement between the bottom surface of the putter and grass during a putting stroke. Still further, the taper at the bottom of the putter eliminates the possibility that an unevenly cut segment of grass will impede the putting stroke and cause an errant putt. Additional features of the invention include the utilization of a weighted plate 73 to lower the center of gravity of the putter and a coating of aluminum oxide or other similar coating to provide for friction on the putting face and to facilitate adherence of the low friction coating to the underside of the putter.

Having described several embodiments of a new and improved golf putter constructed in accordance with the present invention, it is believed that other modifications, variations and changes will be suggested to those skilled in the art in view of the above description. It is therefore to be understood that all such variations, modifications and changes are believed to fall within the scope of the invention as defined in the appended claims.

I claim:

1. A golf putter including a club head comprising:

a top surface;

a bottom surface;

proximal and distal ends;

a forward-facing putting face extending lengthwise between said proximal and distal ends and extending depthwise between said top and bottom surfaces;

wherein said putting face and said bottom surface intersect in a lengthwise-extending forward bottom edge of the club head;

wherein said forward bottom edge includes a substantially straight intermediate segment spaced from both of said distal and proximal ends, and first and second straight end segments extending from opposite ends of said intermediate segment to said proximal and distal ends, respectively, said first and second end segments being mutually divergent depth-wise of said putting face in a direction toward said top surface; and wherein said bottom surface includes: a flat planar base portion extending lengthwise between said proximal and distal ends and extending widthwise to include said intermediate segment, said base portion having a length which is greater than said intermediate segment; a first recessed portion bounded by said first end segment, said proximal end and said base portion; and a second recessed portion bounded by said second end segment, said distal end and said base portion.

2. The golf putter according to claim 1 wherein said first and second recessed portions are respective flat planar areas of said bottom surface which intersect said base portion.

3. The golf putter according to claim 2 wherein said flat planar recessed portion areas are of substantially identical configuration and intersect said base portion at substantially identical angles.

4. The golf putter according to claim 3 wherein said angles are 2.5 degrees.

5. The golf putter according to claim 1 wherein said base portion of said bottom surface includes all of said bottom surface with the exception of said first and second recessed portions.

6. The golf putter according to claim 1 further comprising a club shaft secured to said club head at a location which is centered between said proximal and distal ends.

7. The golf putter according to claim 6 further comprising sighting means disposed on said top surface of said club head and centered longitudinally of said intermediate segment for facilitating alignment of a player's line of sight with a position centered lengthwise of said intermediate segment.

8. The golf putter according to claim 7 wherein said intermediate segment is substantially centered between said proximal and distal ends, and wherein said first and second end segments have substantially equal lengths.

9. The golf putter according to claim 8 further comprising weighting means for lowering the center of gravity of said club head, said weighting means comprising a plate of relatively heavy material disposed within said club head.

10. The golf putter according to claim 1 further comprising sighting means disposed on said top surface of said club head, centered longitudinally of said intermediate segment, for facilitating alignment of a player's line of sight with the position centered lengthwise of said intermediate segment.

11. The golf putter according to claim 1 further comprising means for lowering the center of gravity of said club head and including a plate of relatively heavy material disposed within said club head.

12. A golf putter comprising a club head having a bottom surface intersecting a forward-facing putting face to define a bottom edge, said club head having a length dimension defined between a proximal end and a distal end, said bottom surface having a lowermost flat portion with different lengths along said bottom surface, the shortest of said lengths being disposed at a straight intermediate segment of said bottom edge, wherein said bottom edge includes first and second straight end segments which are coplanar with and flank said intermediate segment, said end segments each sloping upward and away from said intermediate segment in respective opposite lengthwise directions along said club head.

13. The golf putter according to claim 12 wherein said putter face includes an optimal ball-striking location which is centered with respect to said intermediate segment.

14. The golf putter according to claim 12 wherein said bottom surface includes first and second flat planar recessed portions, said first recessed portion being bounded by said first end segment, said proximal end segment and said base portion, wherein said second recessed portion is bounded by said second end segment, said distal end and said base portion.

15. The golf putter according to claim 12 further comprising a club shaft secured to said club head at a location which is centered between said proximal and distal ends.

16. The golf putter according to claim 12 further comprising sighting means disposed on said top surface of said club head and centered longitudinally of said intermediate segment for facilitating alignment of a player's line of sight in a position centered lengthwise of said intermediate segment.

17. The golf putter according to claim 12 further comprising weighting means for lowering the center of gravity of said club head, said weighting means comprising a plate of relatively heavy material disposed within said club head.

* * * * *